United States Patent [19]

Walter

[11] 4,324,084

[45] Apr. 13, 1982

[54] METHOD OF APPLYING CEMENTITIOUS MATERIAL TO A MORTAR JOINT

[76] Inventor: Roy A. Walter, 1701 W. Spring St., Lima, Ohio 45805

[21] Appl. No.: 115,330

[22] Filed: Jan. 25, 1980

[51] Int. Cl.[3] ..... E04B 1/00

[52] U.S. Cl. ..... 52/744; 15/160; 15/206

[58] Field of Search ..... 52/744; 427/429, 260; 15/105.5, 235.3, 235.4, 160, 206

[56] References Cited

U.S. PATENT DOCUMENTS

| | | | |
|---|---|---|---|
| 2,895,155 | 7/1959 | Peterson | 15/206 X |
| 3,384,943 | 5/1968 | James | 15/235.3 X |
| 3,608,944 | 9/1971 | Turner | 15/235.3 X |

FOREIGN PATENT DOCUMENTS

| | | | |
|---|---|---|---|
| 457,061 | 11/1936 | United Kingdom | 15/235.3 |

*Primary Examiner*—Price C. Faw, Jr.
*Assistant Examiner*—Carl D. Friedman
*Attorney, Agent, or Firm*—Bernard, Rothwell & Brown

[57] ABSTRACT

Cementitious material is applied to a mortar joint by the use of a center-wire axial brush. The brush is loaded with the material, placed in contact with the joint so that the longitudinal axis of the brush lies along the length of the mortar joint, and then drawn along the length of the joint thereby to apply the material along the joint in the form of a constant-width strip having sharply defined longitudinal edges.

1 Claim, 5 Drawing Figures

FIG. 1
PRIOR ART
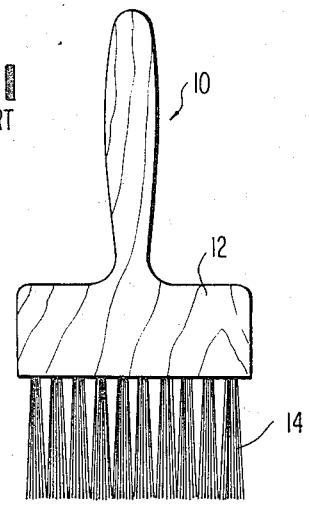
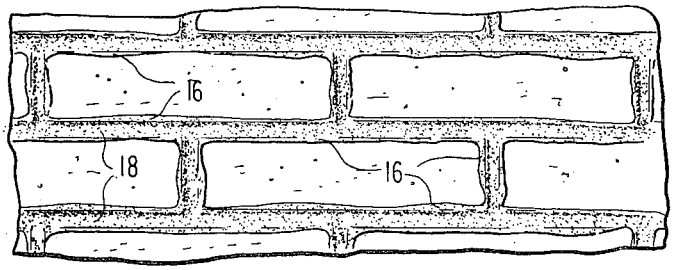
FIG. 2
PRIOR ART
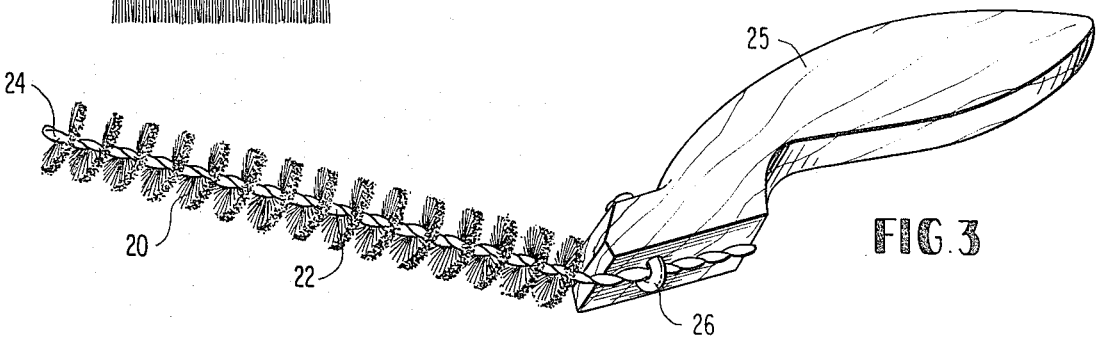
FIG. 3
FIG. 4
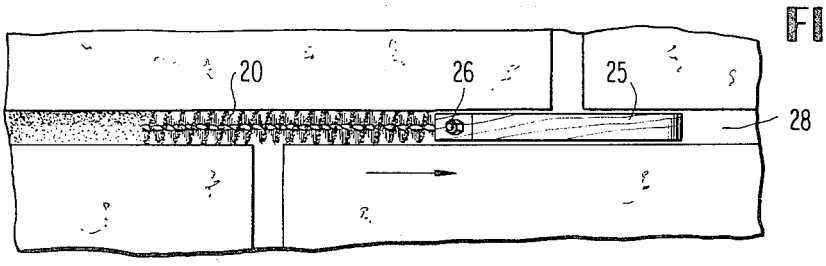
FIG. 5
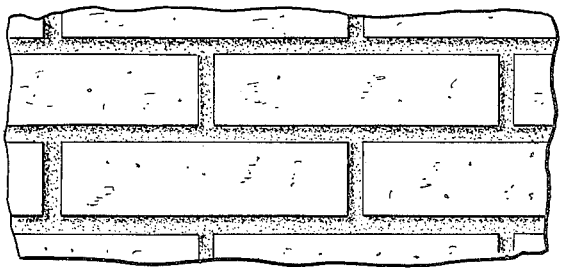

METHOD OF APPLYING CEMENTITIOUS MATERIAL TO A MORTAR JOINT

BACKGROUND OF THE INVENTION

1. Field of the Invention

This invention relates generally to the field of methods of applying liquid and semi-liquid coatings to surfaces and, more particularly, to a method of applying a cementitious material to a mortar joint.

2. Description of the Prior Art

Traditionally, cementitious material has been applied to mortar joints by the use of a conventional brush: e.g., a brush having a wooden handle and bristles all extending in the same direction from the handle in a manner similar to a conventional paint brush. However, when the conventional brush is dipped in a cementitious coating material and then drawn or stroked across a mortar joint, the bristles are bent by the drawing motion, thereby allowing individual bristles to roam rather freely in different directions, depending on the irregularity of the surface and the steadiness of the user's hand, just as the bristles of a conventional paint brush bend when applying paint. Thus, there is a thicker coating where the brush is first applied and also where the contour of the mortar joints and brick slightly bulges toward the user because of irregularities in the original wall surface. Conversely, where the wall falls slightly away, the coating becomes thinner. Consequently, there is produced a series of irregular cementitious coating lines, similar to the irregular bulges and thin lines produced when "cutting" window sash with a conventional paint brush. Furthermore, when the bristles of a conventional mortar brush are bent by the drawing motion, they assume varying lengths, whereby, when they jump out of the groove of the mortar joint, they contact, and thereby coat, the adjacent brick surfaces which are not supposed to be coated. To avoid this undesirable and unsightly uneveness of the applied coating, some persons have gone to the extreme of masking the bricks in order to assure a neat and even application of a protective coat of cementitious material to the mortar joint, but such a technique is extremely expensive and time-consuming.

Thus, there is a long standing need in the art for an improved method for applying to a mortar joint a cementitious coating which has the neat and even appearance of this tedious masking technique. The improved method should be simple and inexpensive and not require special training or special artistic skill of the user.

SUMMARY OF THE INVENTION

Thus, the primary object of the invention is to provide an improved method of applying to a surface a coating material in the form of a line or strip having a constant width and sharp longitudinal edges.

A more specific object is to provide a method of applying to a mortar joint an even coating of cementitious material in the form of a line or strip having the neat and even appearance of a masked joint.

One form of the invention may be briefly summarized as a method of applying cementitious material to a mortar joint by the use of center-wire axial brush having relatively stiff bristles projecting radially outwardly from the center wire to which the bristles are secured.

BRIEF DESCRIPTION OF THE DRAWING

FIG. 1 illustrates a prior art brush of the type which is conventionally used to apply cementitious material to a mortar joint.

FIG. 2 illustrates the messy and uneven appearance of the mortar joint after application of the cementitious material by the prior art brush of FIG. 1.

FIG. 3 illustrates the preferred form of brush used to apply cementitious material to a mortar joint in accordance with this invention.

FIG. 4 illustrates the manner in which the brush of FIG. 3 is used to apply cementitious material to a mortar joint in accordance with this invention.

FIG. 5 illustrates the neat and even appearance of a mortar joint after being coated with cementitious material in accordance with the method of this invention.

DETAILED DESCRIPTION OF THE PREFERRED EMBODIMENT

FIG. 1 illustrates a conventional brush 10 which is presently used to apply a cementitious coating to a mortar joint. The brush consists basically of a handle 12 in which are fixed bristles 14 all of which extend outwardly in one direction from the handle. FIG. 2 illustrates the irregular and uneven nature of the cementitious coating when applied to a mortar joint with the conventional brush of FIG. 1. More particularly, because of the varying lengths of the brush bristles as described above, the coating material is undesirably applied to the brick surfaces 16 adjacent the mortar joint 18.

FIG. 3 illustrates the preferred form of center-wire axial brush used in the improved method of this invention for applying a cementitious coating to a mortar joint. The relatively short, relatively stiff bristles 20 are secured in a well-known manner between the adjacent spiral surfaces of the stiff center-wire 22 which is formed of a single stiff wire or rod which is bent back upon itself at the free end 24 and tightly twisted to form the tight spiral surfaces between which the bristles are secured. The two free ends of the twisted wire are then secured to a handle 25 by any suitable means, such as by the J-bolt and nut assembly 26 shown in FIG. 3. The handle is preferably disposed at approximately an angle of 45° with respect to the axis of the center-wire 22 to facilitate the user's placing of the brush into a mortar joint so that the axis of the brush lies along the length of the joint. In this regard, FIG. 4 schematically illustrates the manner in which the brush, after being loaded with the desired cementitious material, such as by dipping in a container thereof, is laid along the mortar joint 28 and drawn longitudinally to the right along the length of the mortar joint to deposit in the joint an even coating of constant-width.

FIG. 5 illustrates the neat, sharp edged line or strip of coating material formed in a mortar joint by using the brush of FIG. 3 to apply the cementitious coating material to the joint. It is seen that the coating material has been evenly applied to the joint without overlapping the adjacent bridge surfaces. This result is obtained because the brush bristles project radially outwardly at equal distances from the center-wire. Thus, even though the lower most bristles may be flattened while applying the cementitious material to the mortar joint, the resulting coating is in the form of a constant width strip having sharply defined edges as illustrated in FIG.

5. Furthermore, the resulting coating is of even thickness.

The center-wire axial brush illustrated in FIG. 3 has a cylindrical brush surface, and the diameter of the brush is selected such that the bristles fit within the width of the mortar joint such that the outermost edges of the bristles coincide with the edges of the joint. Comparison of FIGS. 2 and 5 emphasize the relative neatness of the coating applied in accordance with this invention as compared to that applied in accordance with the prior art "freehand" brush. Thus, by the use of this invention, a contractor can employ relatively unskilled persons who can produce the neat, "masked" appearance as shown in FIG. 5, without having to hire skilled or artistically talented persons to obtain the same result with the use of the conventional brush shown in FIG. 1.

The method of this invention utilizing the center-wire axial brush can also be used for applying to any smooth or semi-rough surface, such as bricks, a liquid or semi-liquid material in the form of a straight line or strip having a constant width with sharply defined longitudinal edges. Each time the brush is loaded with the coating material and drawn across the surface, a perfectly straight line is made with no bristles dancing out to either side or flattening unevenly, since the bristles are wound on the center-wire and project radially outward therefrom. This straight line will have no bellies or bows and will not produce any "overspray", and, in fact, will resemble a "masked" line. Another application for the method of this invention is in sign painting to produce letters having lines of uniform width, whether the lines be curved or straight.

I claim:

1. A method of applying a liquid cementitious coating material to a mortar joint between two bricks, said method comprising the steps of:

loading a liquid cementitious coating material onto an elongated tubular brush of the type having an elongated axial rod along whose length are fixed brush bristles which extend radially outwardly at equal distrances through at least part of an arc from the longitudinal axis of the rod to form at least part of a cylindrical brush surface to contact a mortar joint;

placing the loaded brush in the mortar joint so that the brush surface is in contact with the mortar joint and so that the longitudinal dimension of the brush is aligned with the longitudinal dimension of the mortar joint; and drawing the brush in a straight line along the longitudinal dimension of the mortar joint so that the coating material is evenly deposited in the joint in the form of a strip of constant width.

* * * * *